US006676776B1

(12) United States Patent
Agarwal et al.

(10) Patent No.: US 6,676,776 B1
(45) Date of Patent: Jan. 13, 2004

(54) 14-KARAT GOLD ALLOY COMPOSITIONS HAVING ENHANCED YELLOW COLOR, REVERSIBLE HARDNESS, AND FINE GRAIN STRUCTURE

(75) Inventors: Dwarika P. Agarwal, Attleboro, MA (US); Grigory Raykhtsaum, Sharon, MA (US)

(73) Assignee: Leach & Garner Company, North Attleboro, MA (US)

( * ) Notice: Subject to any disclaimer, the term of this patent is extended or adjusted under 35 U.S.C. 154(b) by 0 days.

(21) Appl. No.: 10/223,971

(22) Filed: Aug. 20, 2002

(51) Int. Cl.[7] ..... C22C 5/00
(52) U.S. Cl. ..... 148/430; 420/511
(58) Field of Search ..... 148/430; 420/511

(56) References Cited

U.S. PATENT DOCUMENTS 5,045,411 A * 9/1991 Taylor et al. ..... 428/672
5,173,132 A * 12/1992 Solomon ..... 148/405
5,180,551 A * 1/1993 Agarwal ..... 420/511
5,384,089 A * 1/1995 Diamond ..... 420/511
5,749,979 A * 5/1998 Carrano et al. ..... 148/430
6,406,568 B1 * 6/2002 Agarwal et al. ..... 148/430

FOREIGN PATENT DOCUMENTS

DE 3414128 * 12/1985
DE 4423646 * 8/1995
GB 2279662 * 11/1995
RU 2170280 * 7/2001

* cited by examiner

*Primary Examiner*—Sikyin Ip
(74) *Attorney, Agent, or Firm*—Phillips Lytle LLP

(57) ABSTRACT

A 14-karat gold alloy composition having a desirable yellow color and with reversible hardness contains about 58.65 weight percent gold, about 11.5–25.0 weight percent silver, about 11.85–23.35 weight percent copper, and about 2–7 weight percent zinc. The color of the composition has a value of between about −3.0 to about 0.5 CieLab a* color units, and has a value of between about +20.0 to about 22.0 CieLab b* color units. The alloy has a hardness ratio between about 0.4–2.0, and color ratio of less than about 1.0.

16 Claims, 1 Drawing Sheet

(Alloy 20 150X Grain Size = 15 μm)

(Alloy 16 150X Grain Size = 60 μm)

(Alloy 15 150X Grain Size = 35 μm)

(Alloy 14 150X Grain Size = 15μm)

(Alloy 17 150X Grain Size = 25 μm)

(Alloy 19 150X Grain Size = 25 μm)

(Alloy 20 150X Grain Size = 15 μm)

14-KARAT GOLD ALLOY COMPOSITIONS HAVING ENHANCED YELLOW COLOR, REVERSIBLE HARDNESS, AND FINE GRAIN STRUCTURE

TECHNICAL FIELD

The present invention relates generally to 14-karat gold alloy compositions, and, more particularly, to improved 14-karat gold alloy compositions having enhanced yellow color, reversible hardness, and a fine grain structure.

BACKGROUND ART

It is well known that gold, a precious metal, is relatively soft. To this end, it has been known to alloy gold with other elements and compounds in an attempt to improve its hardness and other properties. The amount or quantity of gold in such alloys is commonly expressed in terms of a karat weight. A composition having 100% gold is known as a 24-karat composition. However, if the alloy has a lesser amount of gold, this is commonly expressed in terms of a particular karat weight, which is a percentage of the amount of gold. For example, a 14-karat alloy would have 14/24= 58.33% gold, with the balance being other elements and/or compounds.

The present invention relates generally to 14-karat gold alloy compositions that are used in the manufacturing of jewelry. It has been known to form alloys based on a gold-silver-copper-zinc system. The usage and application of these various alloys are typically defined by their main physical properties, such as hardness, strength, elongation, melting temperature range, grain size, color, and the like. These properties can be measured, and are often incorporated in the specifications of the alloy.

As noted in U.S. Pat. No. 6,406,568, the color of gold alloy compositions is no longer a matter of subjective impression. Rather, a color is now determined objectively in terms of its component colors, a* (green-red) and b* (blue-yellow) on a CieLab color-measuring system. This method of measuring color is described in G. Raykhtsaum et al., "The Color of Gold", A. J. M. (October 1994). While color is now measured objectively, the consumer appeal of a particular color or tint is still subjective.

Some gold alloys have been developed that offer the capability of reversibility, by selective application of an appropriate heat treatment, between their annealed-hardness and aged-hardness values. In many cases, there is a considerable difference between these hardness values. Hence, an alloy may be annealed to lower its hardness value. This allows the alloy to be worked more easily. After the alloy has been worked, and the article thereof formed or repaired, the article may be aged-hardened to a higher hardness value to increase its resistance to denting and deformation. However, if there is a subsequent need to rework or repair the item, it may be annealed to reduce its hardness back down to its annealed-hardness value. After the item has been reworked or repaired, it may be aged-hardened to increase its hardness to a higher hardness value. Some gold alloys having this "reversible" hardness feature are shown and described in U.S. Pat. Nos. 5,180,551 and 6,406,568.

Grain structure is another characteristic that materially affects the value of an alloy. It has been known to add iridium, cobalt and/or nickel to produce an alloy having a fine grain structure. However, the use of these additives have to be closely controlled for fear of separation of these elements or formation of "hard spots" in the alloy. Nickel is a known cause of an allergic reaction with the skin that results in dermatitis. The use of these various grain refiners is discussed in Ott, "Optimizing Gold Alloys for the Manufacturing Process", *Gold Technology*, Issue No. 34 (Spring 2002) [at pp. 37–44].

Other gold alloy compositions are shown and described in U.S. Pat. Nos. 5,173,132 and 5,749,979. The aforesaid articles and each of the aforesaid patents are hereby incorporated by reference.

Accordingly, the present invention relates generally to improved 14-karat gold alloy compositions that have a desirable yellow color, reversible hardness, and a fine grain structure.

DISCLOSURE OF THE INVENTION

The present invention relates generally to various 14-karat gold alloy compositions having a desirable yellow color, and reversible hardness between their annealed- and aged-hardness values. In some cases, the compositions have a highly desirable fine grain structure, which facilities their use in the manufacture of various items of jewelry.

The improved gold alloy compositions broadly include: about 58.65 weight percent gold; about 11.5–25.0 weight percent silver; about 11.85–23.35 weight percent copper; and about 2.0–7.0 weight percent zinc; wherein the color of the composition has a value of between about −3.0 to about 0.5 CieLab a* color units, and a value of between about +20.0 to about +22.0 CieLab b* color units; wherein the ratio of the amount of copper to the amount of silver is between about 0.4–2.0; and wherein the ratio of the amount of copper to the amount of silver plus twice the amount of zinc is less than about 1.0.

The improved composition may further include a grain refiner selected from the group consisting of iridium, cobalt, platinum and iron. The grain refiner may include about 0.2–0.5 weight percent cobalt, 0.1–0.3 weight percent platinum and/or about 0.1–0.3 weight percent iron. In one particularly preferred form, the improved alloy composition has a grain refiner that includes about 0.2 weight percent cobalt, about 0.1 weight percent platinum and about 0.1 weight percent iron. The color of this particular alloy has a value of about −1.1 CieLab a* units and has a value of about +22.0 CieLab b* units, a ratio of the amount of copper to the amount of silver of about 0.6, and a ratio of the amount of copper to the amount of silver plus twice the amount of zinc of about 0.48.

In a second particularly-desirable composition, the color of the composition has a value of about −0.9 CieLab a* units, and has a value of about +21.0 CieLab b* units. In the second preferred desired alloy, the ratio to the amount of copper to the amount of silver is about 2.0, and the ratio of the amount of copper to the amount of silver plus twice the amount of zinc is about 0.94.

The inventive gold alloy compositions have an annealed hardness of at least about 140 VHN after having been heated to about 1150° F. for thirty minutes, followed by a water quench. The improved alloys have an aged hardness of at least about 240 VHN after having been heated to about 600° F. for about one hour, and thereafter being allowed to cool to room temperature. The hardness of the inventive compositions is reversible between their annealed- and aged-hardness values.

Accordingly, the general object of the invention is to provide various improved 14-karat gold alloys.

Another object is to provide improved 14-karat gold alloy compositions having desirable yellow color and reversible hardness characteristics.

Still another object is to provide improved 14-karat gold alloy compositions having desirable yellow color, reversible hardness and a fine grain structure.

These and other objects and advantages will become apparent from the foregoing and ongoing written specification, the drawings, and the appended claims.

DESCRIPTION OF THE PREFERRED EMBODIMENTS

Figure 1:
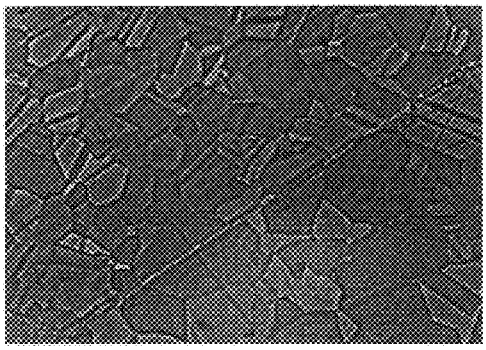
FIG. 1 is a photomicrograph of Alloy 16, taken at a magnification of 150×, and shows an average grain size of about 60 microns.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, Table 1 sets forth compositions of five prior art 14-karat gold alloy compositions. The various alloys are identified as Alloys 1–5, respectively. The table sets forth the weight percentage of gold (i.e., % Au), silver (i.e., % Ag), copper (i.e., % Cu), zinc (i.e., % Zn), cobalt (i.e., % Co), and of nickel (i.e., % Ni). The table also sets forth the hardness ratio (i.e., H), expressed in terms of the % Cu/% Ag (i.e., H=% Cu/% Ag), and the color ratio (i.e., C), expressed in terms of the % Cu divided by the sum of the % Ag plus twice the % Zn (i.e., C=(% Cu/[% Ag+2(% Zn)]). Table 1 also lists the objective color of the alloys in terms of their CieLab a* and b* color components, with a subjective description of color and a statement as to whether the hardness of the alloy is reversible between its annealed-hardness value and its aged-hardness value.

The composition of Alloy 1 is set forth in U.S. Pat. No. 5,173,132. This alloy contains about 58.484% gold, about 11.86% silver, about 23.676% copper, about 2.6% zinc, about 0.38% cobalt, and about 3% nickel. This alloy appears to have a reversible hardness characteristic. The alloy has hardness and color ratios of about H=2.0 and about C=1.4, respectively. The presence of nickel in the composition bleaches this alloy to such an extent that it becomes unacceptable for use in finished jewelry. Hence, it is used for springs and findings in jewelry. Besides bleaching the alloy, nickel is also known to cause allergenic reactions with the skin that result in dermatitis.

Alloy 2 is disclosed in U.S. Pat. No. 5,180,551. This alloy contains about 58.25% gold, about 12.2% silver, about 26.35% copper, about 2.7% zinc and about 0.5% cobalt. This alloy has a yellowish color, with a color of about a*=+3.1 and about b*=+20.0 CieLab color units. The red component, a*, is fairly high in this alloy, which makes the alloy suitable for many jewelry applications where a slight reddish tint is desired. This alloy has hardness and color ratios of about H=2.2 and about C=1.5, respectively. The hardness of this alloy is reversible between its annealed- and aged-hardness values.

Alloy 3 is also disclosed in U.S. Pat. No. 5,180,551 as a prior art composition. It contains about 58.25% gold, about 12.2% silver, about 24.45% copper, about 4.7% zinc, and about 0.4% cobalt. The alloy has CieLab color values of about a*=+1.0 and about b*=+20.0. As a result of its lower a* value (as compared with Alloy 2), the color of Alloy 3 appears as a neutral or pale yellow. This alloy has hardness and color ratios of about H=2.0 and about C=1.1, respectively. The hardness of this alloy is also reversible as between its annealed- and aged-hardness values.

Alloy 4 is disclosed in U.S. Pat. No. 5,749,979. The alloy contains about 58.68% gold, about 13.49% silver, about 23.96% copper, about 3.7% zinc, and about 0.37% cobalt. The alloy has hardness and color ratios of about H=1.8 and about C=1.2, respectively. It has a neutral or pale yellow color, with CieLab color components of about a*=+1.03 and about b*=+20.37. As with Alloys 2 and 3, the hardness of Alloy 4 is reversible between its annealed- and aged-hardness values.

Alloy 5 is made in accordance with ASTM alloy P00235, and contains about 58.33% gold, about 35.00% silver, about 6.47% copper, and about 0.20% zinc. This alloy has hardness and color ratios of about H=0.2 and about C=0.2, respectively. The high silver content in this alloy enhances its color. The alloy has a color of about a*=−4.5 and about b*=+21.0 CieLab color units. This alloy has a distinct greenish tint, and cannot be aged-hardened.

The composition and properties of the improved alloys are summarized in Table 2. The improved alloys are individually identified as Alloys 6–21, respectively. The various columns indicate the weight percentage of gold (i.e., % Au), silver (i.e., % Ag), copper (i.e., % Cu), zinc (i.e., % Zn), cobalt (i.e., % Co), platinum (i.e., % Pt), and iron (i.e., % Fe). The hardness and color ratios, as previously defined, are again indicated in the columns labeled "H" and "C" respectively. The color of each alloy is indicated in terms of its CieLab a* and b* values. A subjective description of the color is then provided, and the annealed- and aged-hardness values in terms of their Vickers Hardness Number (VHN) then listed in the rightwardmost columns.

Alloy 6 has about 58.65% gold, about 25.0% silver, about 11.85% copper, about 4.0% zinc, and about 0.5% cobalt. The hardness and color ratios are about H=0.5 and about C=0.36, respectively. This alloy has a color of about a*=−2.2 and about b*=+22.0 CieLab color units. The alloy appears to have an enhanced yellow-green color. The alloy has an annealed-hardness of about 165 VHN, and an aged-hardness value of about 260 VHN.

Alloy 7 has about 58.65% gold, about 22.0% silver, about 11.95% copper, about 7.0% zinc, about 0.2% cobalt, about 0.1% platinum, and about 0.1% iron. The hardness and color ratios of Alloy 7 are about H=0.5 and about C=0.33, respectively. Alloy has a color of about a*=−3.1 and about b*=+21.5 CieLab color units. This alloy has an enhanced green color. The alloy has an annealed-hardness of 145 VHN, and aged-hardness of 260 VHN.

Alloy 8 contains about 58.65% gold, about 25.0% silver, about 13.95% copper, about 2.0% zinc, about 0.2% cobalt, about 0.1% platinum, and about 0.1% iron. The hardness and color ratios are about H=0.6 and about C=0.48, respectively. The color of the alloy is about a*=−1.1 and about b*=+22.0 CieLab units. This alloy appears to have an enhanced yellow color. The alloy has an annealed-hardness value of 160 VHN, and aged-hardness value of 265 VHN.

Alloy 9 has about 58.65% gold, about 19.0% silver, about 18.95% copper, about 3.0% zinc, about 0.2% cobalt, about 0.1% platinum and about 0.1% iron. The hardness and color ratios of this alloy are about H=1.0 and about C=0.76, respectively. The color of this alloy is about a*=+0.5 and about b*=21.5 CieLab color units. This alloy appears to have an enhanced yellow color. This alloy has an annealed-hardness of about 170 VHN, and an aged-hardness value of about 265 VHN.

Alloy 10 has about 58.65% gold, about 15.1% silver, about 23.11% copper, about 2.74% zinc, and about 0.4% cobalt. Alloy 10 has hardness and color ratios of about H=1.5 and about C=1.12, respectively. The color of this alloy is about a*=+1.2 and about b*=+20.5 CieLab units. This alloy appears to have a pale yellow color. The alloy has an annealed-hardness value of about 185 VHN, and an aged-hardness value of about 280 VHN.

Alloy 11 contains about 58.65% gold, about 14.4% silver, about 23.05% copper, about 3.5% zinc, and about 0.4% cobalt. The hardness and color ratios of this alloy are H=1.6 and C=1.08, respectively. The color of this alloy is about a*=+1.1 and about b*=+20.5 CieLab units. This alloy also appears to have a pale yellow color. Alloy 11 has an annealed-hardness value of about 175 VHN, and an aged-hardness value of about 270 VHN.

Alloy 12 contains about 58.65% gold, about 13.5% silver, about 22.95% copper, about 4.5% zinc, and about 0.4% cobalt. The hardness and color ratios of this alloy are about H=1.7 and about C=1.02, respectively. The color of this alloy is about a*=+1.1 and about b*=+20.5 CieLab units. This alloy also appears to have a pale yellow tint. Alloy 12 has an annealed-hardness value of about 170 VHN, and an aged-hardness value of about 275 VHN.

Alloy 13 contains about 58.65% gold, about 11.5% silver, about 23.95% copper, about 5.5% zinc, and about 0.4% cobalt. This alloy has hardness and color ratios of about H=2.1 and about C=1.06, respectively. The color of this alloy is about a*=+0.7 and about b*=+20.0 CieLab units. This alloy also appears to have a pale yellow color. Alloy 13 has an annealed-hardness value of about 165 VHN and an aged-hardness value of about 265 VHN.

Figure 3:
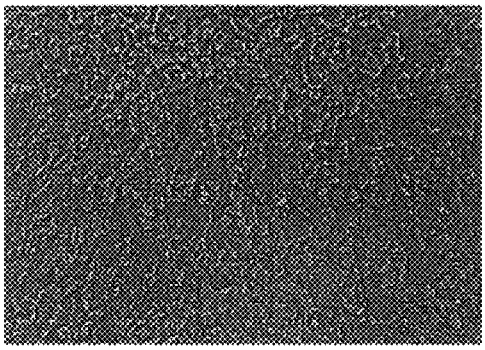
FIG. 3 is a photomicrograph of Alloy 14, taken at a magnification of 150×, and shows an average grain size of about 15 microns.

Alloy 14 contains about 58.65% gold, about 11.5% silver, about 22.95% copper, about 6.5% zinc, and about 0.4% cobalt. This alloy has hardness and color ratios of about H=2.0 and about C=0.94, respectively. The color of this alloy is about a*=−0.9 and about b*=+21.0 CieLab color units. This alloy appears to have an enhanced yellow color. Alloy 14 has an annealed-hardness value of about 165 VHN and an aged-hardness value of about 260 VHN. FIG. 3 shows the microstructure of alloy 14, at 150× magnification. FIG. 3 illustrates that alloy 14 has an average grain size of about 15 microns.

Figure 2:
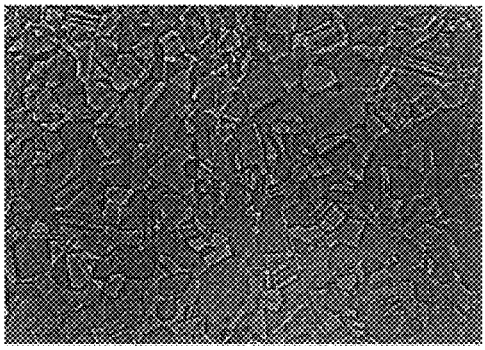
FIG. 2 is a photomicrograph of Alloy 15, taken at a magnification of 150×, and shows an average grain size of about 35 microns.

Alloy 15 has about 58.65% gold, about 11.5% silver, about 23.15% copper, about 6.5% zinc, and about 0.2% cobalt. This alloy has hardness and color ratios of about H=2.0 and about C=0.94, respectively. The color of this alloy is a*=−0.9 and b*=+21.0 CieLab units. This alloy appears to have an enhanced yellow color. Alloy 15 has an annealed-hardness value of about 145 VHN, and an aged-hardness value of about 245 VHN. The microstructure of Alloy 15 is shown in FIG. 2, which is taken at 150× magnification. FIG. 2 illustrates that Alloy 15 has an average grain size of about 35 microns.

Alloy 16 has about 58.65% gold, about 11.5% silver, about 23.35% copper, and about 6.5% zinc. This alloy has hardness and color ratios of about H=2.0 and about C=0.95, respectively. The color of alloy 16 is about a*=−0.9 and about b*=+21.0 CieLab color units. Alloy 16 appears to have an enhanced yellow color. Alloy 16 has an annealed-hardness value of about 145 VHN, and an aged-hardness value of about 240 VHN. The microstructure of Alloy 16 is shown in FIG. 1. It should be noted that Alloy 16 does not have a grain refiner, and that at magnification of 150×, the average grain size is approximately 60 microns.

Figure 4:
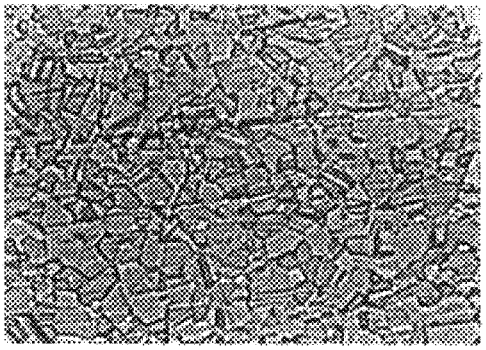
FIG. 4 is a photomicrograph of Alloy 17, taken at a magnification of 150×, and shows an average grain size of about 25 microns.

Alloy 17 contains about 58.65% gold, about 11.5% silver, about 23.15% copper, about 6.5% zinc, about 0.1% platinum and about 0.1% iron. This alloy has hardness and color ratios of about H=2.0 and about C=0.94, respectively. The color of this alloy is about a*=−0.9 and about b*=+21.0 CieLab color units. This alloy appears to have an enhanced yellow color. Alloy 17 has an annealed-hardness value of about 155 VHN and an aged-hardness value of about 245 VHN. FIG. 4 illustrates that Alloy 17, at a magnification of 150×, has an average grain size of Alloy 17 is about 25 microns.

Alloy 18 contains about 58.65% gold, about 11.5% silver, about 22.95% copper, about 6.5% zinc, about 0.2% platinum, and about 0.2% iron. This alloy has hardness and color ratios of about H=2.0 and about C=0.94, respectively. The color of this alloy is about a*=−0.9 and about b*=+21.0 CieLab color units. This alloy appears to have an enhanced yellow color. Alloy 18 has an annealed-hardness value of about 150 VHN, and an aged-hardness value of about 255 VHN.

Figure 5:
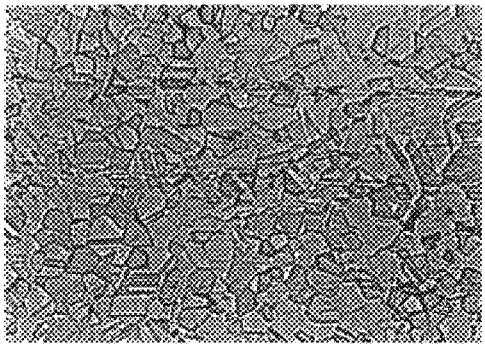
FIG. 5 is a photomicrograph of Alloy 19, taken at a magnification of 150×, and shows an average grain size of about 25 microns.
Figure 6:
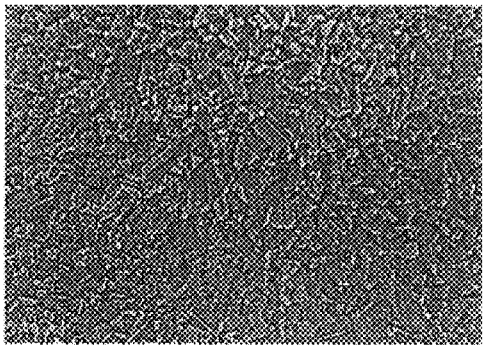
FIG. 6 is a photomicrograph of Alloy 20, taken at a magnification of 150×, and shows an average grain size of about 15 microns.

Alloy 19 contains about 58.65% gold, about 11.5% silver, about 22.75% copper, about 6.5% zinc, about 0.3% platinum, and about 0.3% iron. This alloy has hardness and color ratios of about H=2.0 and about C=0.93, respectively. The color of this alloy is about a*=−0.9 and about b*=+21.0 CieLab color units. This alloy appears to have an enhanced yellow color. Alloy 19 has an annealed-hardness value of about 150 VHN, and an aged-hardness value of about 255 VHN. The microstructure of Alloy 19 is shown in FIG. 5, at a magnification of about 150×. FIG. 5 illustrates that Alloy 19 has an average grain size of about 25 microns.

Alloy 20 contains about 58.65% gold, about 11.5% silver, about 22.95% copper, about 6.5% zinc, about 0.2% cobalt, about 0.1 platinum, and about 0.1% iron. This alloy has hardness and color ratios of about H=2.0 and about C=0.94, respectively. The color of this alloy is about a*=−0.9 and about b*=+21.0 CieLab color units. This alloy appears to have an enhanced yellow color. Alloy 20 has an annealed-hardness of about 155 VHN, and an aged-hardness of about 260 VHN. The microstructure of Alloy 20 is shown in FIG.

6, at a magnification of 150×. Alloy 20 has an average grain size of about 15 microns.

Finally, Alloy 21 contains about 58.65% gold, about 11.5% silver, about 22.75% copper, about 6.5% zinc, about 0.2% cobalt, about 0.2% platinum, and about 0.2% iron. This alloy has hardness and color ratios of about H=2.0 and about C=0.93, respectively. The color of this alloy is about a*=−0.9 and about b*=+21.0 CieLab color units. This alloy appears to have an enhanced yellow color. Alloy 21 has an annealed-hardness value of about 155 VHN, and an aged-hardness value of about 250 VHN.

In prior art alloys, shown in Table 1, iridium or cobalt, or a combination of these two elements, have been used as grain refiners. Both these elements work well, but their method of addition and concentration have to be controlled. Variation from this control may result in segregation of these elements, and/or the formation of hard spots. A recent description of these features have been shown and described in Ott, "Optimizing Gold Alloys for the Manufacturing Process", *Gold Technology*, Issue No. 34, Spring 2002 (pp. 37–44), the aggregate disclosure of which is hereby incorporated by reference.

Applicants' study has shown that platinum and iron may be used as grain refiners in lieu of iridium and/or cobalt. The addition of platinum and iron in a 1:1 weight ratio appears to promote the formation of an $Fe_3Pt$ intermetallic compound that acts as a grain refiner. Alloys 17, 18 and 19 show that this Pt—Fe addition provides effective grain refining. Alloy 20 shows that the combination of Pt—Fe, with a small amount of cobalt, increases the grain refining effect. Applicants' study also shows that the addition of Pt—Fe with a small amount of cobalt results in an alloy that is softer, as compared with an alloy that just had the equal amount of cobalt alone.

Modifications

The present invention contemplates that various changes and modifications may be made within the numerical ranges set forth in the appended claims.

Therefore, while the preferred forms of the improved compositions have been shown and described, and several modifications thereof discussed, persons skilled in this art will readily appreciate that various additional changes and modifications may be made without departing from the spirit of the invention, as defined and differentiated by the following claims.

What is claimed is:

1. A 14-karat gold alloy composition, comprising:

about 58.65 weight percent gold;

about 11.5–25.0 weight percent silver;

about 11.85–23.35 weight percent copper; and about 2–7 weight percent zinc;

wherein the color of said composition has a value of between about −3.0 to about +0.5 CieLab a* color units, and has a value of about between about +20.0 to +22.0 CieLab b* color units;

wherein the ratio of the amount of copper to the amount of silver is between about 0.4–2.0; and wherein the ratio of the amount of copper to the amount of silver plus twice the amount of zinc is less than about 1.0.

2. A 14-karat gold alloy composition as set forth in claim 1 and further comprising at least one grain refiner selected from the group consisting of cobalt, platinum and iron.

3. A 14-karat gold alloy composition as set forth in claim 2 wherein said grain refiner includes about 0.2–0.5 weight percent cobalt.

4. A 14-karat gold alloy composition as set forth in claim 2 wherein said grain refiner includes about 0.1–0.3 weight percent platinum.

5. A 14-karat gold alloy composition as set forth in claim 2 wherein said grain refiner includes about 0.1–0.3 weight percent iron.

6. A 14-karat gold alloy composition as set forth in claim 2 wherein said grain refiner includes about 0.2 weight percent cobalt, about 0.1 weight percent platinum, and about 0.1 weight percent iron.

7. A 14-karat gold alloy composition as set forth in claim 6 wherein said wherein the color of said composition has a value of about −1.1 CieLab a* color units, and has a value of about +22.0 CieLab b* color units.

8. A 14-karat gold alloy composition as set forth in claim 7 wherein the ratio of the amount of copper to the amount of silver is about 0.6.

9. A 14-karat gold alloy composition as set forth in claim 8 wherein the ratio of the amount of copper to the amount of silver plus twice the amount of zinc is about 0.48.

10. A 14-karat gold alloy composition as set forth in claim 2 wherein said wherein the color of said composition has a value of about −0.9 CieLab a* color units, and has a value of about +21.0 CieLab b* color units.

11. A 14-karat gold alloy composition as set forth in claim 10 wherein the ratio of the amount of copper to the amount of silver is about 2.0.

12. A 14-karat gold alloy composition as set forth in claim 11 wherein the ratio of the amount of copper to the amount of silver plus twice the amount of zinc is about 0.94.

13. A 14-karat gold alloy composition as set forth in claim 1 wherein said composition has an annealed hardness of at least about 140 VHN after having been heated to about 1150° F. for thirty minutes, followed by a water quench.

14. A 14-karat gold alloy composition as set forth in claim 13 wherein said composition has an aged hardness of at least about 240 VHN after having been heated to about 600° F. for about one hour, and thereafter being allowed to cool to room temperature.

15. A 14-karat gold alloy composition as set forth in claim 14 wherein the hardness of said composition is reversible between said annealed- and aged-hardness values.

16. A 14-karat gold alloy composition as set forth in claim 1 wherein said composition has an aged hardness of at least about 240 VHN after having been heated to about 600° F. for about one hour, and thereafter being allowed to cool to room temperature.

* * * * *

UNITED STATES PATENT AND TRADEMARK OFFICE

CERTIFICATE OF CORRECTION

PATENT NO. : 6,676,776 B1
DATED : January 13, 2004
INVENTOR(S) : Dwarika P. Agarwal et al.

It is certified that error appears in the above-identified patent and that said Letters Patent is hereby corrected as shown below:

Column 7,
Line 61, insert Tables 1 and 2 as shown below:

Table 1. Prior Art Alloys

| Alloy | Composition (w/o) | | | | | | Ratios | | Color | | | Reversible Hardness? |
|---|---|---|---|---|---|---|---|---|---|---|---|---|
| | Au | Ag | Cu | Zn | Co | Ni | H | C | a* | b* | Description | |
| 1 | 58.484 | 11.86 | 23.676 | 2.6 | 0.38 | 3.0 | 2.0 | 1.4 | | | N/A | Yes |
| 2 | 58.250 | 12.20 | 26.350 | 2.7 | 0.50 | | 2.2 | 1.5 | +3.10 | +20.00 | Yellow | Yes |
| 3 | 58.250 | 12.20 | 24.450 | 4.7 | 0.40 | | 2.0 | 1.1 | +1.00 | +20.00 | Pale Yellow | Yes |
| 4 | 58.680 | 13.49 | 23.960 | 3.7 | 0.37 | | 1.8 | 1.2 | +1.03 | +20.37 | Pale Yellow | Yes |
| 5 | 58.330 | 35.00 | 6.470 | 0.2 | | | 0.2 | 0.2 | -4.50 | +21.00 | Green | No |

UNITED STATES PATENT AND TRADEMARK OFFICE

CERTIFICATE OF CORRECTION

PATENT NO. : 6,676,776 B1
DATED : January 13, 2004
INVENTOR(S) : Dwarika P. Agarwal et al.

It is certified that error appears in the above-identified patent and that said Letters Patent is hereby corrected as shown below:

Column 7 (cont'd),

Table 2. Improved Alloys

| Alloy | Composition (w/o) | | | | | | | Ratios | | Color | | | Hardness (VHN) | |
|---|---|---|---|---|---|---|---|---|---|---|---|---|---|---|
| | Au | Ag | Cu | Zn | Co | Pt | Fe | H | C | a* | b* | Description | Ann. | Aged |
| 6 | 58.65 | 25.0 | 11.85 | 4.00 | 0.5 | | | 0.5 | 0.36 | -2.2 | +22.0 | Enhanced Yellow-Green | 165 | 250 |
| 7 | 58.65 | 22.0 | 11.95 | 7.00 | 0.2 | 0.1 | 0.1 | 0.5 | 0.33 | -3.1 | +21.5 | Enhanced Green | 145 | 260 |
| 8 | 58.65 | 25.0 | 13.95 | 2.00 | 0.2 | 0.1 | 0.1 | 0.6 | 0.48 | -1.1 | +22.0 | Enhanced Yellow | 160 | 265 |
| 9 | 58.65 | 19.0 | 18.95 | 3.00 | 0.2 | 0.1 | 0.1 | 1.0 | 0.76 | +0.5 | +21.5 | Enhanced Yellow | 170 | 265 |
| 10 | 58.65 | 15.1 | 23.11 | 2.74 | 0.4 | | | 1.5 | 1.12 | +1.2 | +20.5 | Pale Yellow | 185 | 280 |
| 11 | 58.65 | 14.4 | 23.05 | 3.50 | 0.4 | | | 1.6 | 1.08 | +1.1 | +20.5 | Pale Yellow | 175 | 270 |
| 12 | 58.65 | 13.5 | 22.95 | 4.50 | 0.4 | | | 1.7 | 1.02 | +1.1 | +20.5 | Pale Yellow | 170 | 275 |
| 13 | 58.65 | 11.5 | 23.95 | 5.50 | 0.4 | | | 2.1 | 1.06 | +0.7 | +20.0 | Pale Yellow | 165 | 265 |
| 14 | 58.65 | 11.5 | 22.95 | 6.50 | 0.4 | | | 2.0 | 0.94 | -0.9 | +21.0 | Enhanced Yellow | 165 | 260 |
| 15 | 58.65 | 11.5 | 23.15 | 6.50 | 0.2 | | | 2.0 | 0.94 | -0.9 | +21.0 | Enhanced Yellow | 145 | 245 |
| 16 | 58.65 | 11.5 | 23.35 | 6.50 | | | | 2.0 | 0.95 | -0.9 | +21.0 | Enhanced Yellow | 145 | 240 |
| 17 | 58.65 | 11.5 | 23.15 | 6.50 | | 0.1 | 0.1 | 2.0 | 0.94 | -0.9 | +21.0 | Enhanced Yellow | 155 | 245 |
| 18 | 58.65 | 11.5 | 22.95 | 6.50 | | 0.2 | 0.2 | 2.0 | 0.94 | -0.9 | +21.0 | Enhanced Yellow | 150 | 255 |
| 19 | 58.65 | 11.5 | 22.75 | 6.50 | | 0.3 | 0.3 | 2.0 | 0.93 | -0.9 | +21.0 | Enhanced Yellow | 150 | 255 |
| 20 | 58.65 | 11.5 | 22.95 | 6.50 | 0.2 | 0.1 | 0.1 | 2.0 | 0.94 | -0.9 | +21.0 | Enhanced Yellow | 155 | 260 |
| 21 | 58.65 | 11.5 | 22.75 | 6.50 | 0.2 | 0.2 | 0.2 | 2.0 | 0.93 | -0.9 | +21.0 | Enhanced Yellow | 155 | 250 |

Signed and Sealed this

Seventh Day of December, 2004

JON W. DUDAS
*Director of the United States Patent and Trademark Office*